United States Patent [19]

Geasland

[11] Patent Number: 4,779,736

[45] Date of Patent: Oct. 25, 1988

[54] TUBULAR PLASTIC SHIPPING, STORAGE AND DISPENSING CONTAINER

[76] Inventor: Gordon Geasland, Box 159, St. George, Staten Island, N.Y. 10301

[21] Appl. No.: 780,998

[22] Filed: Sep. 27, 1985

[51] Int. Cl.[4] ..... B65D 33/10

[52] U.S. Cl. ..... 206/524.8; 206/806; 206/822; 383/7; 383/26; 383/103; 383/121

[58] Field of Search ..... 206/524.8, 806, 802, 206/822, 384, 442, 69; 383/3, 7, 26, 103, 100, 121, 904

[56] References Cited

U.S. PATENT DOCUMENTS

| | | | |
|---|---|---|---|
| 1,053,492 | 2/1913 | Hadfield . | |
| 2,066,282 | 12/1960 | Geiser . | |
| 2,319,448 | 5/1943 | Frostad . | |
| 2,564,163 | 8/1951 | Leperre . | |
| 2,619,801 | 12/1952 | Evans | 383/103 |
| 2,671,578 | 3/1954 | McBean . | |
| 2,751,127 | 6/1956 | Mitton . | |
| 2,816,690 | 12/1957 | Lari . | |
| 2,821,338 | 1/1958 | Metzger | 383/103 |
| 2,980,300 | 4/1961 | Waddington et al. | 222/570 |
| 3,019,950 | 2/1962 | Callegari | 222/570 |
| 3,057,517 | 10/1962 | Douglas . | |
| 3,156,350 | 11/1964 | Lockwood . | |
| 3,171,571 | 3/1965 | Daniels . | |
| 3,225,967 | 12/1965 | Heimgartner . | |
| 3,229,813 | 1/1966 | Crowe, Jr. et al. | 383/103 |
| 3,432,087 | 3/1969 | Costello | 383/103 |
| 3,468,471 | 9/1969 | Linder | 383/102 |
| 3,589,506 | 6/1971 | Ford . | |
| 3,663,239 | 5/1972 | Rowe et al. | 383/103 |
| 3,851,688 | 12/1974 | deWinter . | |
| 4,122,993 | 10/1978 | Glas | 383/103 |
| 4,466,553 | 8/1984 | Zenger . | |

OTHER PUBLICATIONS

Dualpax six-page informational piece (date unknown).

*Primary Examiner*—Joseph Man-Fu Moy
*Attorney, Agent, or Firm*—Caesar, Rivise, Bernstein, Cohen & Pokotilow, Ltd.

[57] ABSTRACT

This invention pertains to a container made of a rigid tubular conformation. Each end of the tube is flattened at a substantial central portion to produce and provide a protruding end portion, and in this flattened and sloped end or portion at least one access aperture is formed. This aperture is selectively closed by a plug, valve or cap adapted to be secured in a fluid-tight manner in this container. Usually this container is made from thermoplastic pipe or tubing from three inches to more than two feet in diameter. The ends are sealed to prevent contamination or ingress of water and the like. The ends are sealed to keep contents from getting out. Hand holds may be formed where the ends are sealed. This tubular container is made with a small amount of tooling and minimum skills by the fabricator. These containers can and may be made economically with very short-run processes, and size extent and length may be changed easily. Disposable and renewable bladders, bags and/or liners can be used with these containers. The bladders can be taken out for removal, repair or replacement. The bladder can be extended out of the fitting and can be gathered together and sealed to provide a sanitary and tamper-proof covering. The container may be pressurized if desired.

42 Claims, 11 Drawing Sheets

TUBULAR PLASTIC SHIPPING, STORAGE AND DISPENSING CONTAINER

BACKGROUND OF THE INVENTION

1. Field of the Invention

With respect to the classification of art as established by and in the U.S. Patent Office, this invention is believed to be found in the general class entitled "Special Receptacle or Package" (Class 206) and pertains to containers made of tubular plastic with at least one access port or hole closed with a fluid-tight and removable cover or cap. This container is made for excluding moisture from the stored contents during shipping, storing and dispensing of solids or fluids. This container may include an internal bladder or liner where high sanitation or inert conditions are desired or vital.

2. Description of the Prior Art

Storage containers are found in many sizes, shapes and constructions. The storage container of this invention contemplates using thermoplastic tubing such as PVC or the like. The tubing may be of any configuration such as round or rectangular and is usually made in long lengths which are then cut to desired lengths. Tubular containers for rod-like members, powders and fluids are not new and among the many found in general class identified above are U.S. Pat. No. 1,682,179 to KREMBS, as issued Aug. 28, 1928, which pertains to retaining a grouping of welding rods. This is an erected carton with side panels of relatively a strong blank. This container is not contemplated to be fluid-tight. U.S. Pat. No. 2,464,278 to WILSON, as issued Mar. 15, 1949, showed a tubular member, but the end caps do not suggest a fluid-tight enclosure. U.S. Pat. No. 2,491,213, as issued to ROBINSON Jr. on Dec. 13, 1949, showed a tubular enclosure with sheet metal caps or bungs. The tubular portion is of cardboard or fiber and the like. The containers are contemplated for shipping and do not suggest a fluid-tight enclosure. U.S. Pat. No. 2,975,888 to PAYNTON Sr., as issued Mar. 21, 1961, disclosed an archery package for storage and shipping arrows. A fluid-tight enclosure is not taught.

Also noted is U.S. Pat. No. 3,084,788 to FORD, as issued Apr. 9, 1963, which pertains to a knitting needle holder of thin plastic tubing and there is no suggestion of strength and fluid-tight construction. A rod toter is shown in U.S. Pat. No. 3,235,148, as issued to HONHART on Feb. 15, 1966. This toter is open to the top although for welding rods which may total several pounds. U.S. Pat. No. 3,847,274 to INGLISH, issued Nov. 12, 1974, pertains to a capillary tube dispenser and uses an open top cup to hold these tubes. U.S. Pat. No. 4,029,202 to LASICH, as issued June 14, 1977, shows a one-piece plastic cap used with a tube member. There is no teaching of making the container fluid-tight. U.S. Pat. No. 4,051,992, as issued to BERGSTEIN on Oct. 4, 1977, shows a tubular container, but there is no teaching of a fluid-tight container.

SUMMARY OF THE INVENTION

This invention may be summarized, at least in part, with respect to its objects.

It is an object of this invention to provide, and it does provide, a tubular container of thermoplastic having sufficient wall thickness to be substantially rigid and with the ends heated and flattened so as to be welded, fused or bonded together to form a fluid-tight seal. At least one aperture is formed in this container wall and a cap, plug or other closure device is provided to make the interior accessible and fluid-tight.

It is a further object of this invention to provide, and it does provide, a plastic tubular container in which the length may be selected. The diameter is also of a desired size. The length is selected by simply cutting lengths to suit from a longer length supply and the diameter may be changed by selecting a larger or smaller diameter of tubing.

It is a further object of this invention to provide, and it does provide, a container that is not only fluid-tight but with an opening or aperture to the interior. This aperture is formed in that flattened end portion so that plugs, caps or other fittings are not exposed to wear or damage due to rough handling during shipping and storage.

As noted above, there are many containers and most are for a particular service. The invention which is shown in the drawings and description thereof contemplates a container made from thermoplastic tubing with the ends flattened and fused, cemented or welded together after the ends have been softened by and with heat. An opening is formed in and at one or both ends and provides access to the interior of the container. This opening is selectively closed with a closure member, plug or cap providing a fluid-tight enclosure.

This plastic container is contemplated for storage of materials having many shapes or may be used for storage of and dispensing of liquids, powders and granular substances and is designed so that the enclosed product can be stored permanently or the container may be used as a dispenser. The container is selected from material that is fire-retardant, shatterproof, corrosion-resistant, waterproof, and resistant to chemicals. It can be made airtight and watertight and the wall thickness is selected so as to withstand high pressures from the outside as well as the inside. An address label can be placed on the container and it can be shipped without repackaging.

This container requires no elaborate or expensive equipment to manufacture, and it can be modified easily to hold a variety of contents. The thermal plastic extruded light-wall tubular materials which can be used for the container are readily available and relatively inexpensive compared to other container materials. Short-run manufacture is practical for small requirements.

Round, extruded thermal plastic tubing is used because it is common and readily available, but dies could also be made up to extrude a square or rectangular cross-sectional tubing. A "squarish" shape would be treated in the same manner as the round.

This container can be manufactured quickly and easily using a minimum amount of equipment and unskilled labor. Initially, the extruded plastic shell is cut off at the proper length for the use. The ends are uniformly heated by one of various proven method (in an oven, by rotating the length with the ends under an infrared heat source, or even by an ultrasonic heater); cement and/or solvent is applied; and the ends are pressed together and clamped. An opening for venting, filling, pressurizing and dispensing, as well as a built-in handle as depicted, is made with almost any common cutting tool.

The container can be reused, if desired, and sent back to the factory for refills (in the same manner as a deposit bottle) or used for another purpose.

Since the containers are non-sparking, they are well suited for the transport, storage and dispensing of many types of hazardous materials such as volatile liquids and explosives.

In addition to the above summary the following disclosure is detailed to insure adequacy and aid in understanding of the invention. This disclosure, however, is not intended to cover each new inventive concept no matter how it may latter be disguised by variations in form or additions of further improvements. For this reason, there has been chosen a specific embodiment of a container construction with many closure caps or the like. This container may be for dry or wet products as adopted for use for economical storage of components and showing a preferred means for forming said container. This specific embodiment and the several cap closures have been chosen for the purposes of illustration and description as shown in the accompanying drawings wherein:

BRIEF DESCRIPTION OF THE DRAWINGS

FIG. 12 B represents a diagrammatic side view of a tubeless tire-type valve stem mounted in an aperture in the container, this valve stem usually for pressurizing the container;

In the following description and in the claims, various details are intended to be generic in their application. Corresponding reference characters refer to like members throughout the several figures of the drawings.

The drawings accompanying, and forming part of, this specification disclose details of construction for the purpose of explanation, but structural details may be modified without departure from the concept and principles of the invention and the invention may be incorporated in other structural forms than shown.

CONTAINER OF FIGS. 1, 2 AND 3

Figure 2:
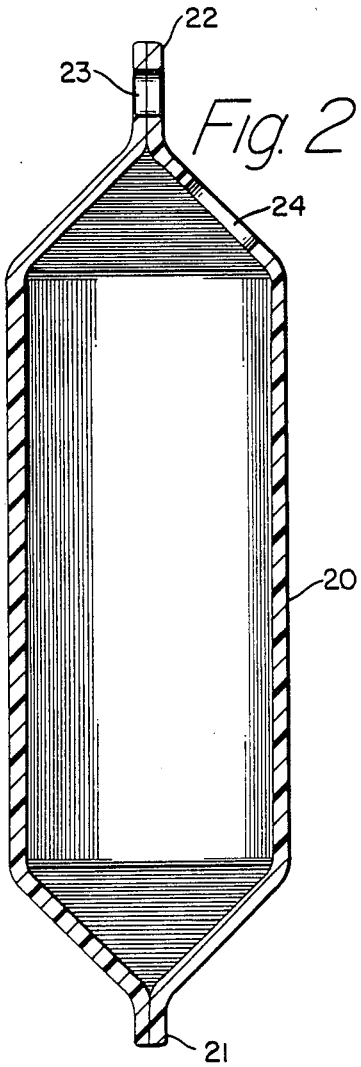
FIG. 2 represents a sectional view of the container of FIG. 1, this view taken on the line 2—2 thereof and looking in the direction of the arrows.

Referring next to the drawings showing a tubular container of this invention, there is depicted a container, generally identified as 20. This container is contemplated as to be made from a tubular length of thermoplastic material which is commercially available in long lengths such as ten to forty feet. The diameter of this tubing is usually from three to twenty-seven inches. The wall thickness for said container is at least one-sixteenth of an inch and may be more than one-quarter of an inch in thickness. The wall thickness is determined by the intended use for the container. The length of the container is a matter of selection. To provide the depicted container, the longer length of pipe is cut to a selected length. After cutting, the ends are heated by known means so that the end portions may be formed into a desired shape or configuration. With and by simple clamp or die means, the end portions 21 and 22 are plattened to be brought to each other to provide a bond, fuse or a welding of these ends. Cement, adhesive or solvents may also be used to insure that the bonded or fused ends are fluid-tight and are in a parallel, substantially side-by-side manner. As can be seen best in FIG. 1, the flattened end portions 21 and 22 have a transverse dimension, substantially normal to the length of the container, between transversely spaced-apart lateral edges 25. These lateral edges are spaced transversely beyond outer peripheral surface 29 of the undeformed body portion of the container 20. As depicted, end 21 is made only sufficient for closing to bring this end portion into a flattened and sealed condition. It is to be noted that the corners can be rounded to remove unwanted sharp ends or corners. This contouring of the corners is easily provided by dies, abrasive tools or saws. The other end is also heated and, as seen in FIG. 2, is also flattened to bring this end into a side-by-side relationship. This end 22 is depicted as made longer than end 21 and in this end is formed a hand grip aperture 23. Other holes or configurations may be made, particularly those for indexing and/or suspension. Both ends can be made longer to provide these apertures. Both ends are usually processed substantially simultaneously. Hand holes such as depicted are for manipulation and as a convenience carrying the container. It is contemplated that this end is sealed, fused, welded or bonded as the other end to provide a fluid-tight closure. As can be seen best in FIG. 1, one of the sloped end transition portions 33 of the container is formed an aperture 24 which is selectively closed by closure devices depicted in later discussed FIGS. The end transition portions 33 join each of the end portions 21 and 22 to the undeformed body portion, and include flared, transversely spaced-apart laterally extending surfaces 37 extending from the lateral edges 25 to the outer peripheral surface 29 of the body portion of the container.

UNTHREADED PLUG CLOSURE OF FIG. 4

The container 20 described above has an aperture 24 providing access to the interior of said container. This aperture may be closed selectively by and with a molded plug, generally identified as 26. This plug is shown with an integral flange 27 which is designed to prevent the molded plug from being forced through the aperture 24. This plug has a cup-shaped portion 28 which conventionally has a taper provided therein. This molded plug member is made slightly resilient to conform to the formed aperture 24 while allowing insertion and removal of the cap to be achieved.

THREADED CAP AND NIPPLE CLOSURE OF FIG. 5

The container 20 shown above and the aperture 24 formed in a side wall portion receive and retain a threaded nipple member 30 which is secured as by welding, cementing or bonding to the container wall. This nipple member 30 may be of plastic or metal and the attached nipple shank portion is desirably made fluid-tight by means such as adhesive, cement or welding. It is contemplated that mounting of this nipple is permanent so that the nipple may not be rotated accidentally. A tapered, threaded portion 31 of this nipple is depicted, and to seal or close this outer threaded portion a tapered threaded plastic or metal cap member 32 is shown removably mounted on this nipple member 30. The threaded end of this nipple may be used for the attaching or removably attaching of other types or styles of tapered, threaded fittings.

THREADED HALF COUPLING AND PLUG CLOSURE OF FIG. 6

Figure 5:
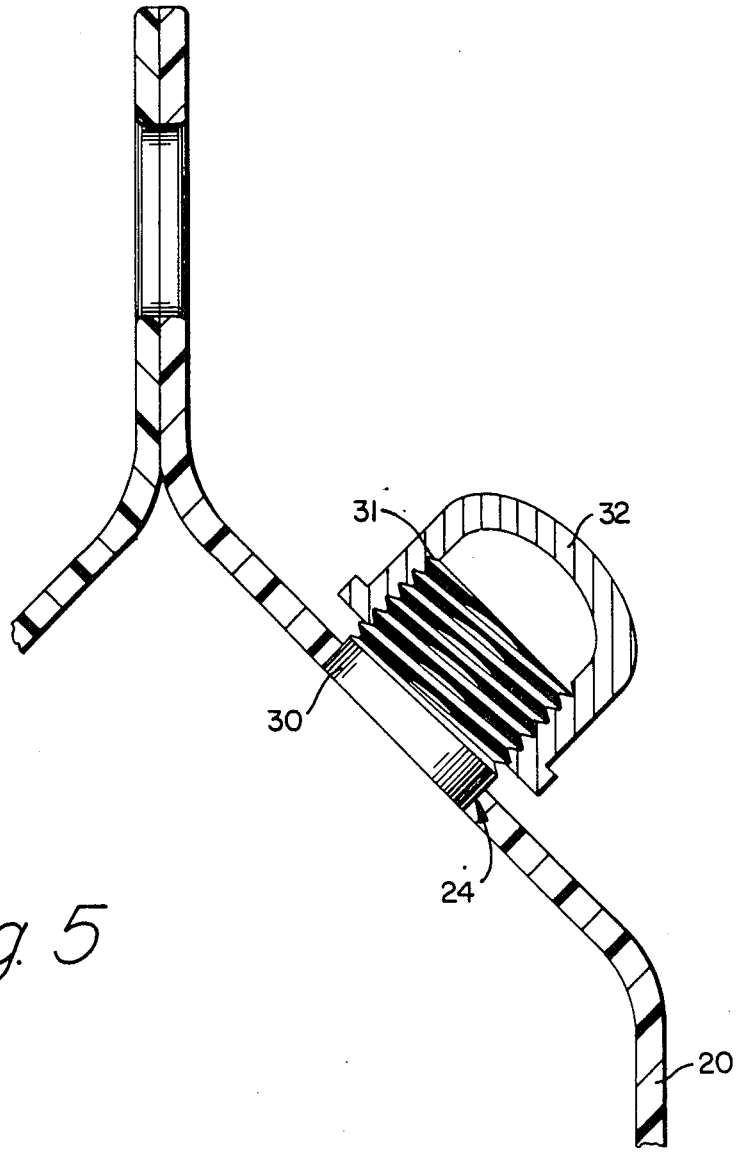
FIG. 5 represents a partly fragmentary and sectional view of another closure means for the aperture formed in the end of the container.

This showing pertains to a half coupling 34 secured in aperture 24 by cement, welding or the like. Rather than exterior threads and a female cap as in FIG. 5, an alternate closure of said container opening 24 is shown. A half coupling 34 has internal tapered threads 35, which opening in this half coupling is selectively closed by a tapered threaded plug 36 which is a conventional pipe plug. This pipe plug may be of metal or plastic and no patentable distinction is made therefor. The threaded half coupling may also be used for attaching valves or like types of threaded fittings.

THREADED PLUG CLOSURE OF FIG. 7

Figure 6:
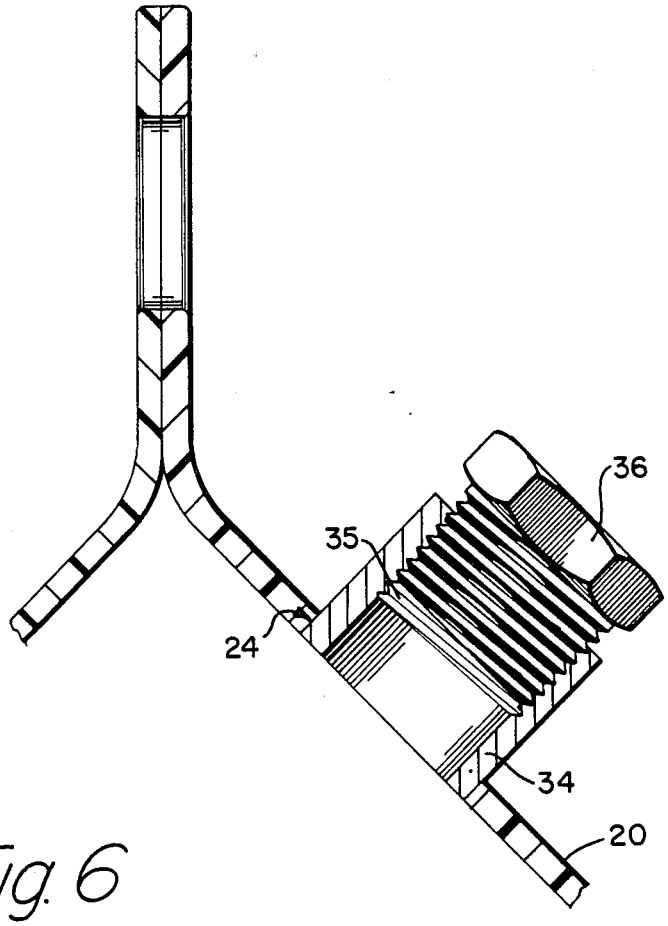
FIG. 6 represents a partly fragmentary and sectional side view of yet another closure concept or means for a closure for the aperture formed in the end of the container.
Figure 7:
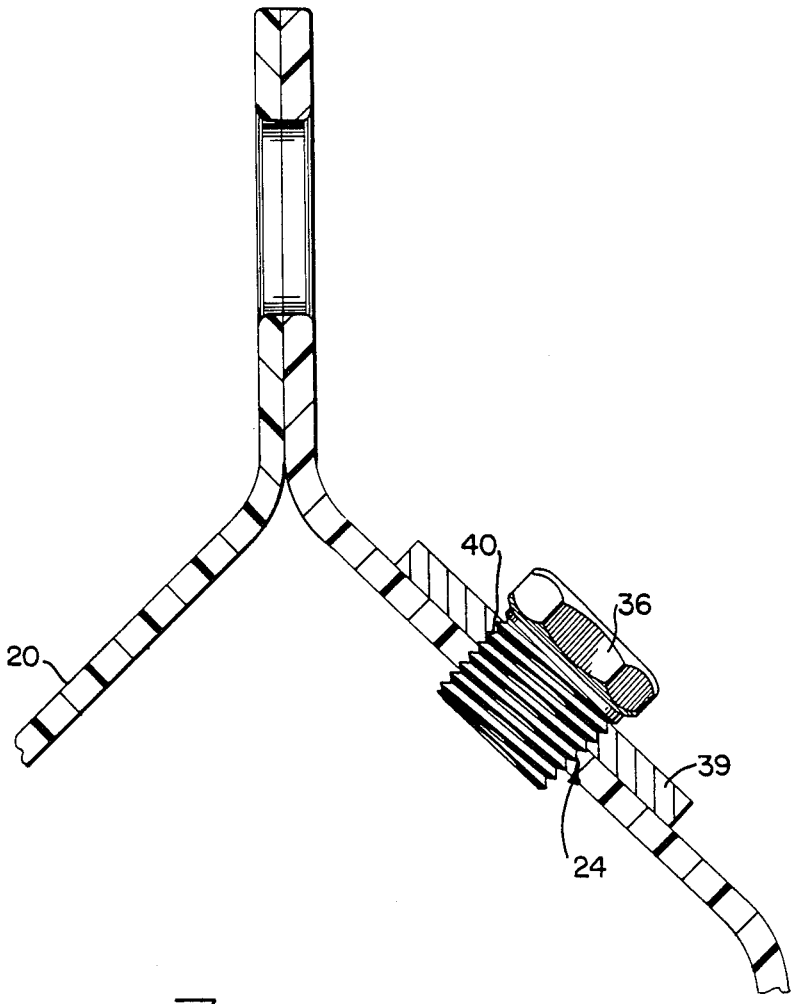
FIG. 7 represents a partly fragmentary and sectional side view of yet another closure concept of means for a closure for the aperture formed in the end of the container.

It is to be noted in this embodiment that where the wall of the container 20 is normally rather thin, the aperture 24 may be reinforced and made substantially thicker by the addition of a cemented, bonded or welded doubler patch 39. This doubling of the wall thickness at the aperture 24 enables this doubler patch and wall of container 20 to have through formed threads 40 made by a tap. In this threaded portion a removably retained pipe plug 36 may be inserted as shown and described in connection with FIG. 6. It is to be noted that the drilled hole and tapping of this hole are performed after attachment of patch or doubler 39.

FILLER SPOUT CLOSURE OF FIG. 8

Figure 8:
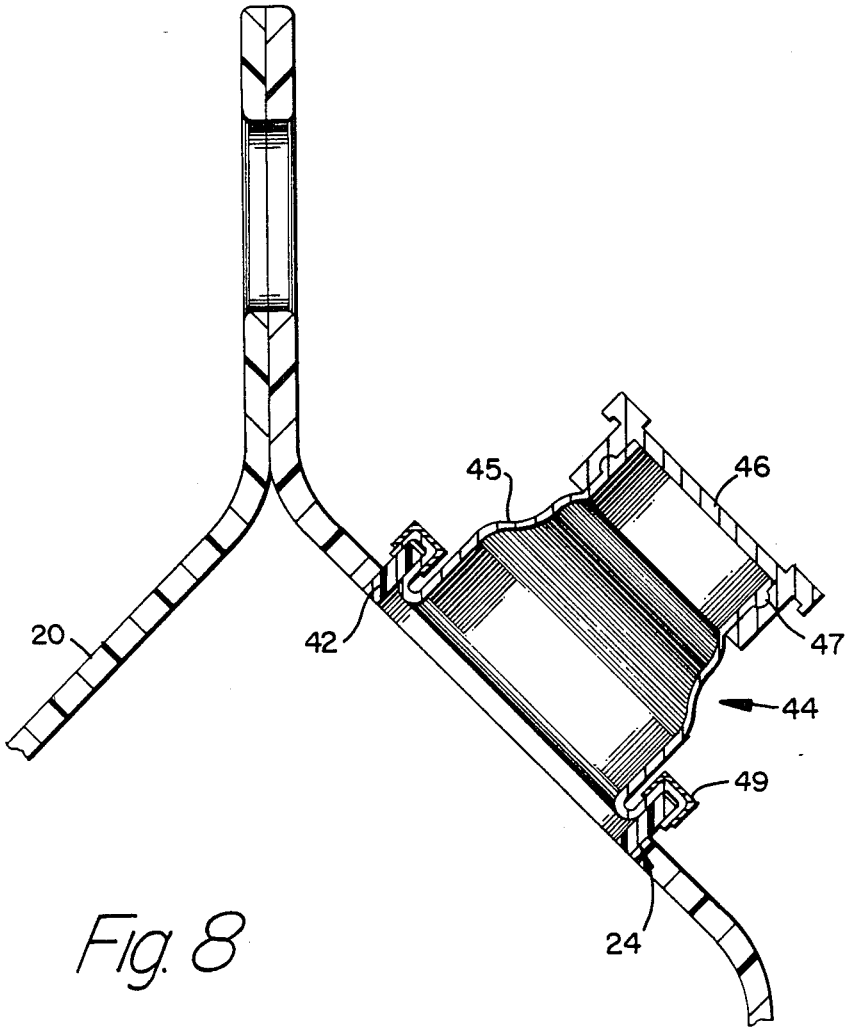
FIG. 8 represents a partly fragmentary and sectional side view of yet another closure concept or means for a closure for the aperture formed in the end of the container.

In FIG. 8, the aperture 24 is shown as closed selectively with a commerically-available product. A tubular collar or neck member 42 is cemented, bonded or welded in place in the aperture to provide a protruding collar portion for attaching one end of this closure member, generally identified as 44. A flexible tubular portion 45 is attached at one end to the collar portion of member 42. The other end of flexible portion 45 is closed with a threaded molded cap 46 which is shown with a fast-thread portion 47. This flexible spout member 45 provides advantages for certain products and components. As depicted, a U-shaped ring 49 engages both the collar member 42 and a mating portion of the spout tubular portion 45. The ring 49 is caused to be closed with squeeze tools or the like so the spout 45, collar 42 and ring 49 provide a fluid-tight seal at this joining.

EXPANDING PLUG CLOSURE OF FIGS. 9 A AND 9 B

Figure 9B:
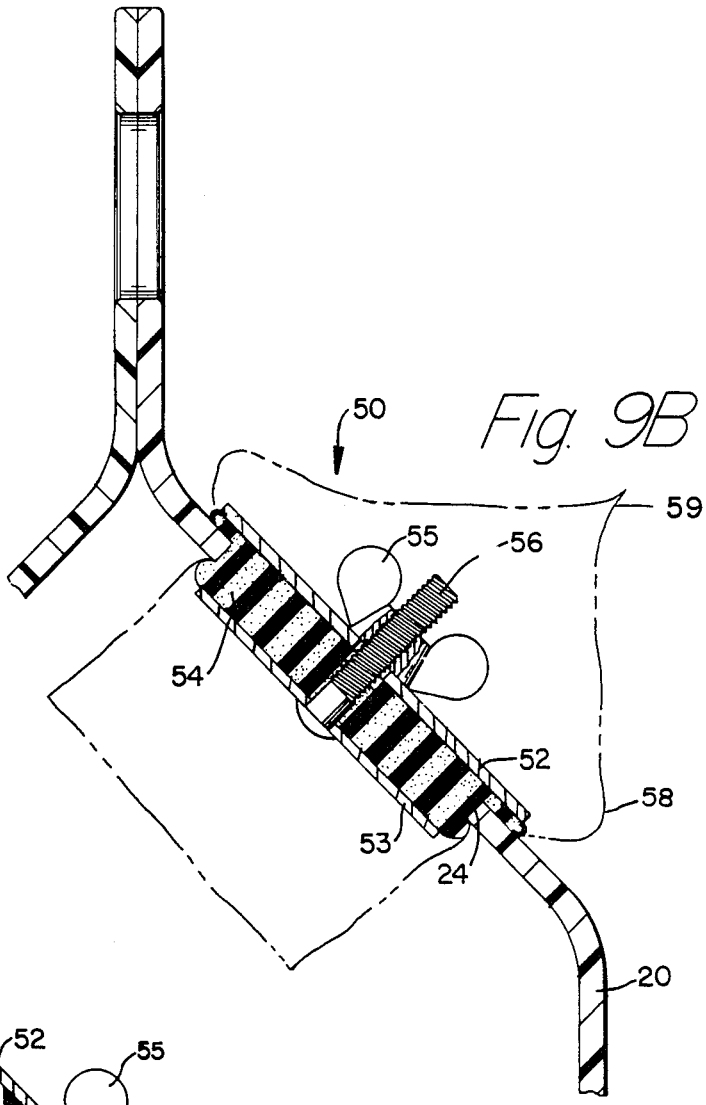
FIGS. 9 A and 9 B represent a side sectional, fragmentary view of a closure plug employing a resilient central portion that is forced radially outward with a squeeze actuation to provide a seal of an aperture.
Figure 9A:
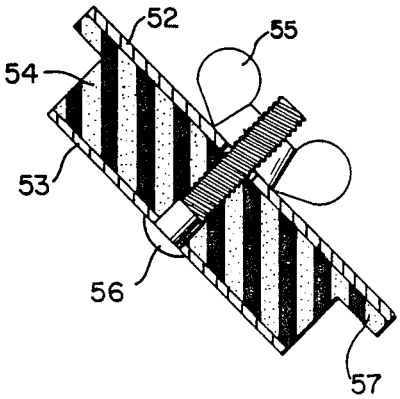

In FIGS. 9 A and 9 B, the aperture 24 is shown as closed with a plug assembly, generally identified as 50. This closure device has outer and inner rigid compression plates 52 and 53, with the inner plate 53 small enough to readily pass through the aperture 24. As depicted, the outer compression plate 52 is made sufficiently large so that there is no possibility of its passing through aperture 24 into the interior of the container. Carried between the inner and outer plates is a rubber or rubber-like resilient, flanged disc 54 which is caused to be compressed by thumb or wing nut 55 which is mounted on a threaded shank of carriage bolt 56. The rotating of the wing nut 55 inwardly causes the resilient disc portion 54 to compress and be expanded radially and outwardly to seal the aperture 24. The rotating of the wing nut provides a squeezing action on the resilient disc 54. An outward movement of the winged nut allows the resilient portion to return to its original form as in FIG. 9A. FIG. 9A is a diagrammatic representation of the removed plug, with the disc-like portion 54 having an outwardly-extending lip portion 57 which provides an outer gasket seal of the plug to the container wall. FIG. 9 B shows the plug in a sealing condition.

A liner may be inserted through the aperture 24 and then the expanding plug closure inserted and manipulated to the condition of FIG. 9 B. The liner may be in the form of a flexible bag for retaining fluids such as milk and the like. This bag is indicated fragmentarily and identified as 58. When a bag is to be used with this container, the lip portion 57 insures that a seal and retaining at the aperture are achieved. It is to be noted that instead of using the wing nut 55, a special nut can be provided and used to prevent tampering. The illustrated closure can be used with or without a bladder or liner bag. Where a flexible liner bag is used, the outer portion of the bag may be drawn around the nut and secured so as to prevent tampering, as is shown in FIG. 9 B. The expanding resilient plug closure may be used to seal the container which can then be pressurized.

VALVE CLOSURE OF FIG. 10

Figure 10:
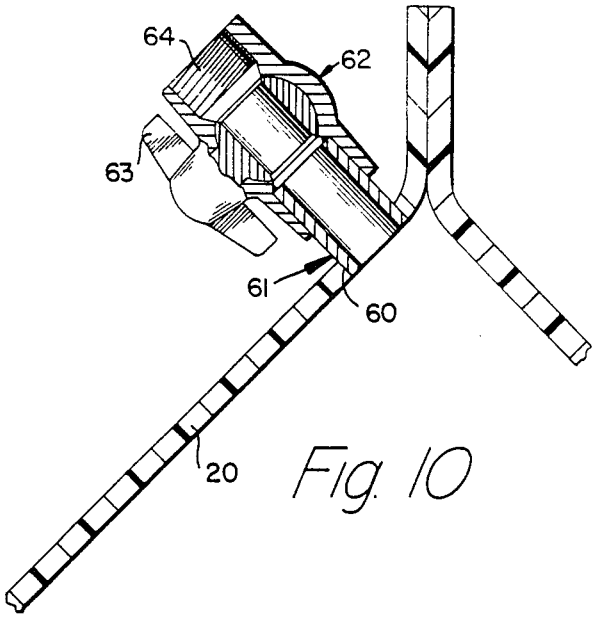
FIG. 10 represents a sectional and partly fragmentary side view of a valve adapted to be selectively turned to open or close the interior of the container for draining or filling the interior of the container.

The embodiment of FIG. 10 anticipates that drainage or filling through a pipe or tube of the container may be desired and that fluid may be desired to be stored within the container. An aperture of reduced diameter and identified as 60 is shown and, rather than the larger aperture 24 of prior embodiments, this aperture 60 is formed in the container side wall and a nipple 61 is fitted therein. This nipple is usually of plastic, but may be of metal. This nipple is cemented, bonded, threaded or welded in place to provide a fluid-tight seal. Mounted and secured to this nipple 61 is a valve 62 which is turned on and off by a wing knob or handle 63 which is manipulable by the user. As depicted, the valve is open for flow to and through the central portion. This valve is also shown with threads 64 in the exterior passageway. This nipple and passageway provide filling and draining of the container by gravity or under pressure.

VENT OF FIG. 11

Figure 11:
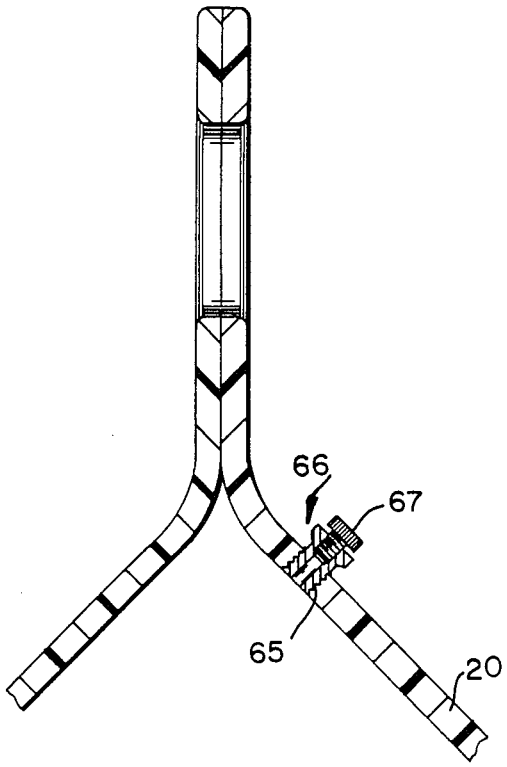
FIG. 11 represents a diagrammatic and sectional side view of a threaded insert providing means to vent the interior of the container and prevent a vacuum.

In FIG. 11 is shown a typical small vent provided in the container side wall. The aperture which is depicted can be threaded and as shown is of a small diameter. The threaded aperture is identified as 65 and a threaded insert 66 is mounted therein. This insert is secured so as to provide a fluid-tight mounting. The outer portion of insert 66 is provided with female threads in which is removable mounted a threaded vent plug 67. This plug when opened allows the interior of the container to be vented. When tightened, the screw 67 closes the vent. It is also noted that many other types of vents are available, some of which are automatic vacuum breakers. Some venting is required with some types of fittings during dispensing from or filling of the container. Such venting prevents vacuum or pressure from developing within the container.

REMOVABLE BLADDER WITHIN THE CONTAINER AS IN FIGS. 12 A AND 12 B

It is to be noted that the container 20 may also be formed so as to retain a bladder within the container. As seen in the FIG. 12 A, it is contemplated that a resilient bag, liner or bladder 70 is inserted within the container 20 through the aperture 24 formed in the end wall of the container 20, in the same manner as described earlier in connection with the liner, bag or bladder 58 in the embodiment shown in FIG. 9B. After insertion, one end of the bladder, liner or bag is retained by the closure member in the aperture 24 formed in container end.

Figure 12A:
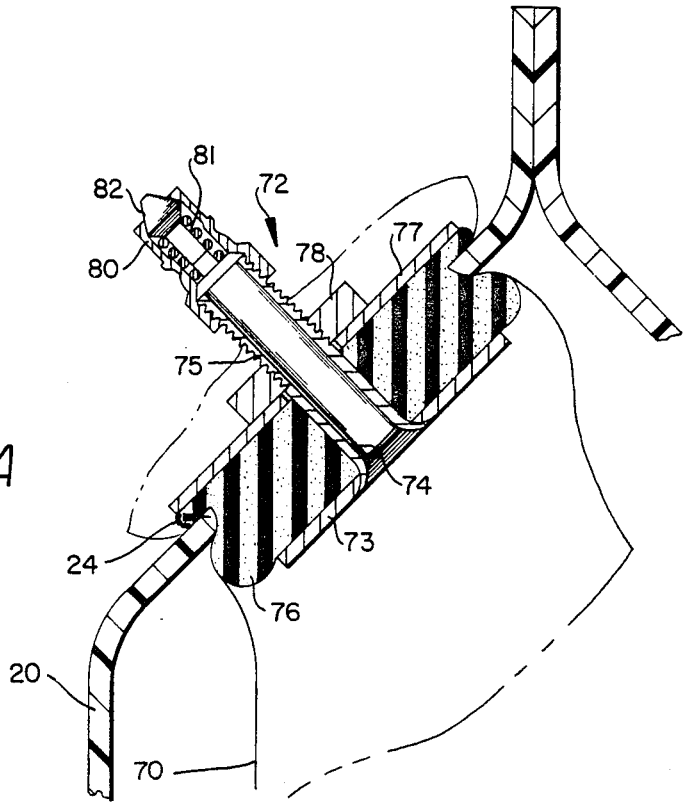
FIG. 12 A represents a sectional and diagrammatic side view of a closure plug with a hollow stem and with a coupling having a check valve, this closure used with a container provided with or without a bladder portion, and with this container usually for dispensing liquid contents from the container.
Figure 12B:
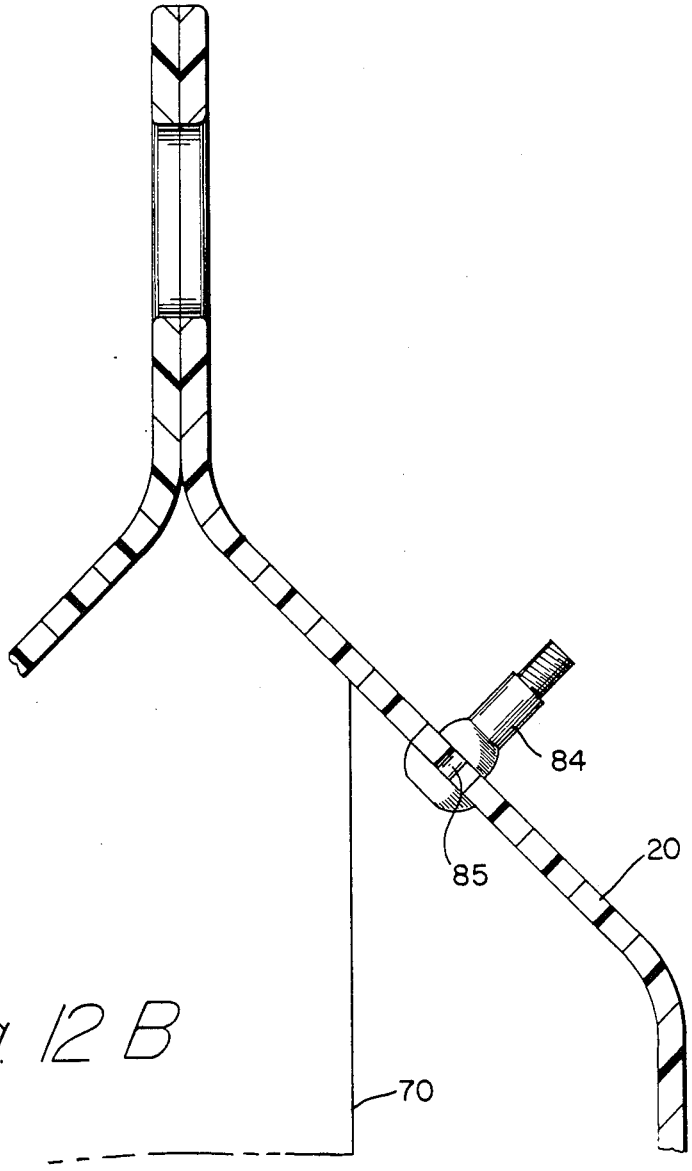

In FIG. 12 A, the bladder 70 is shown as secured to and in the aperture 24 by a closure member, generally identified as 72. An inner plate member 73 has a stem portion 74 integral with or secured thereto and which stem is hollow and has an externally-threaded portion 75. A resilient, flanged disc-like portion 76 is shown. As illustrated in FIG. 12 A, this resilient member is bulged and radially expanded to mate with and seal aperture 24 as formed in the container. This bulged, resilient portion is depicted between inner member 73 and an outer compression plate 77. This plate is moved inwardly by a compression nut 78 which is moved inwardly along threads 75 to capture and retain the bladder or liner (when used) and close the aperture. Removably mounted on the threaded end of the stem portion 74 is a threaded male hydraulic quick coupling 80 in which a spring 81 moves a sealing plunger 82 outwardly. This plunger is moved counterflow to the force of the spring 81 by a female quick coupling member, not shown, to open this passage and provide for fluid filling and/or discharge from within the container and/or bladder or bag.

In FIG. 12 B there is depicted a side view of a tubeless tire-type valve stem which is inserted into a formed hole in the container. This stem member is identified as 84 and the hole in the container is identified as 85. After mounting the valve stem in the container wall, a spring-type check valve (valve core) is inserted. This check valve is easily replaced if and when damaged. Air or gas under pressure is flowed into the container through this stem when the container is to be pressurized with or without a bladder 70 or flexible bag.

The nut 78 may be made so as to be turned only with a special wrench or spanner to provide a measure of tampering protection. With a bag or bladder, the neck of this bag or bladder member may be provided with sufficient length to extend beyond the fitting and by and with a seal or the like, the extending neck portion may be closed and secured to prevent tampering. This procedure may be used for both the device of FIG. 12 A and in FIG. 9 B as discussed above.

SUPPORT STAND OF FIG. 13

Figure 13:
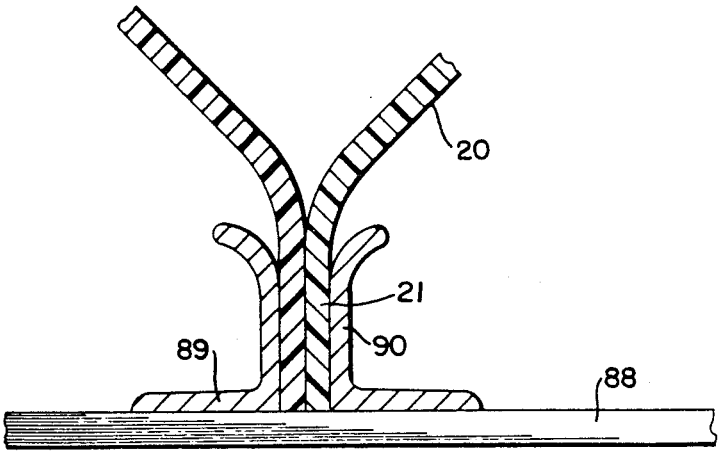
FIG. 13 represents a diagrammatic side view of a bottom or support base providing a stand for the container, and FIGS. 14 A and 14 B represent diagrammatic and fragmentary side and front views of a wall support or bracket for the tubular container of this invention.

In FIG. 13 is diagrammatically shown a support stand for the container 20. This support provides a grip for the flattened and contiguous ends 21 and 22 (FIG. 2) of said formed container. As depicted, a plate member 88 has secured thereto like right- and left-angle members 89 and 90. These angle members are spaced from each other to provide a predetermied slot into which the flattened end of the container (usually the bottom end) may be removably inserted. This support stand is anticipated to maintain the container in a substantially upright condition during storage, shipping and/or other use. Alternate constructions of such a support stand contemplate making the stand as a casting. This stand may be an extrusion which can be cut transversely to length or may be a block member with a formed slot. Whatever the contstruction, it is contemplated that the flattened ends of the container 20 be sized to be removably mounted within support slot means to provide more or less an upright retention and support of the container.

CONTAINER SUPPORT AS IN FIGS. 14 A AND 14 B

Figure 3:
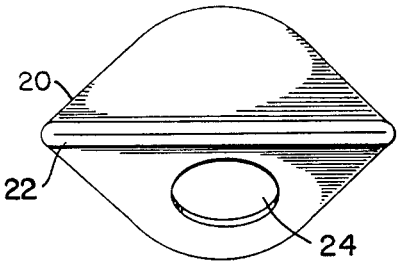
FIG. 3 represents an end view, partly diagrammatic, and showing the container as seen on the line 3—3 of FIG. 1 and looking in the direction of the arrows.
Figure 1:
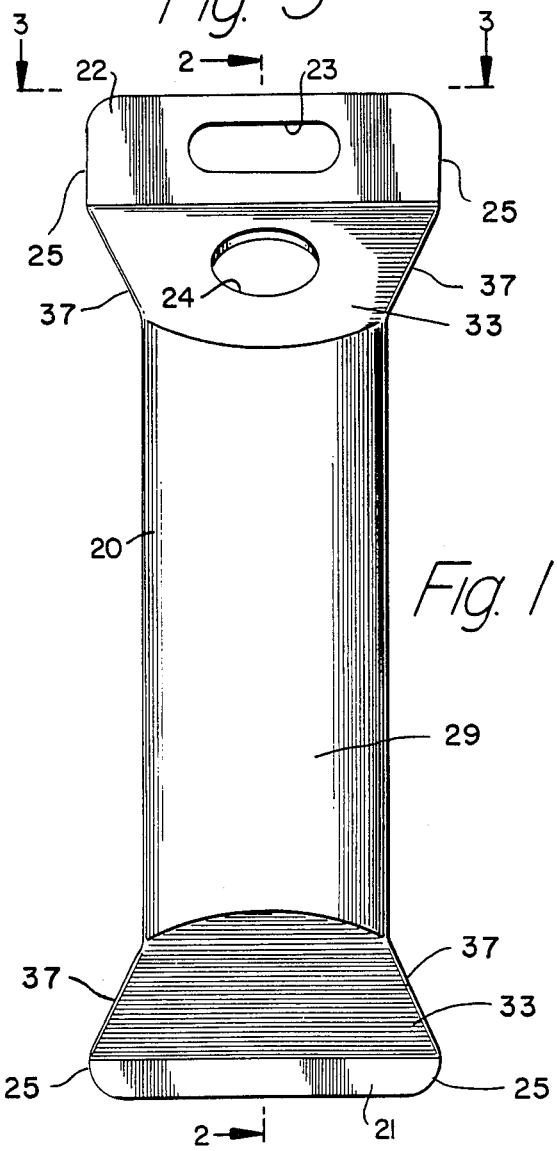
FIG. 1 represents a plan view, partly diagrammatic, and depicting the container of this invention, with one end provided with an access hole and a handle portion.
Figure 4:
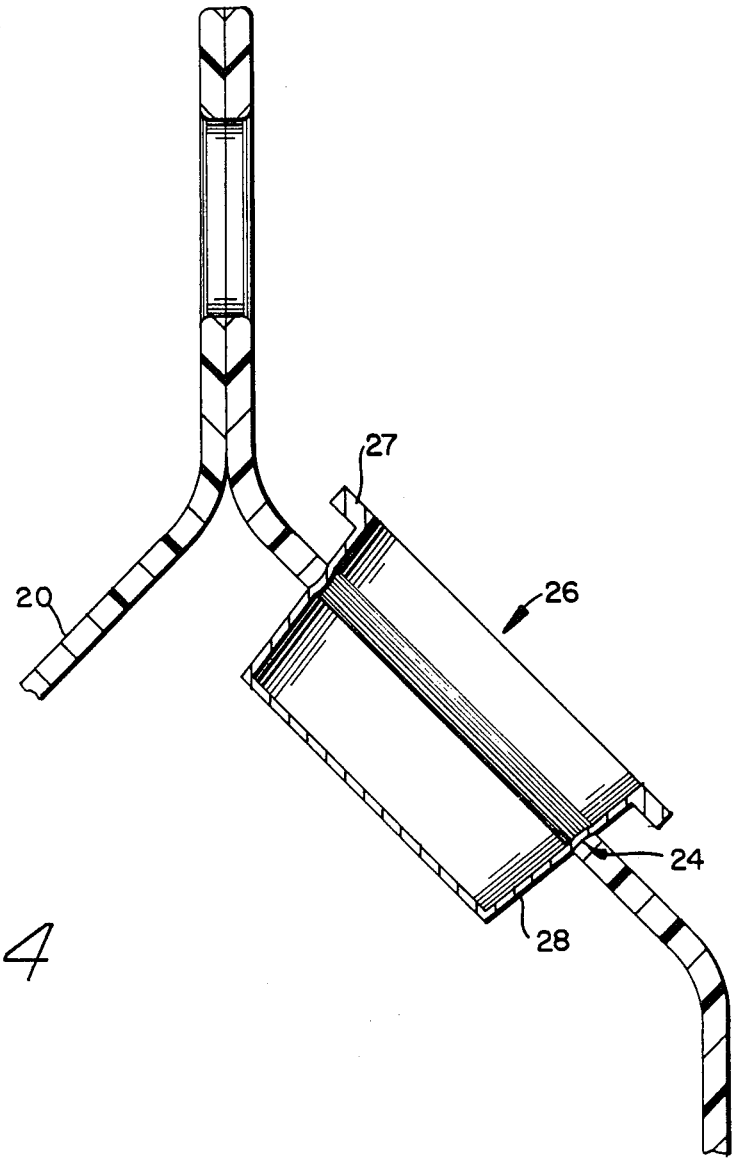
FIG. 4 represents a partly fragmentary and sectional side view of an unthreaded closure plug for the aperture formed in the end of the container.
Figure 14A:
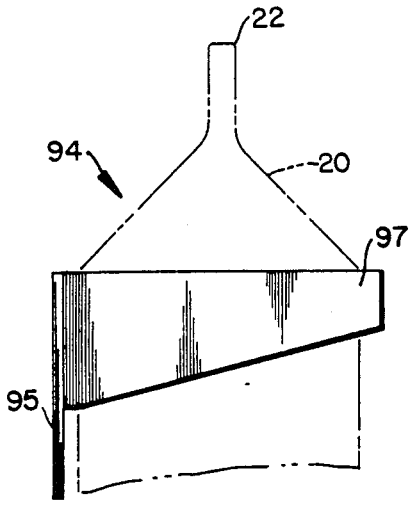
Figure 14B:
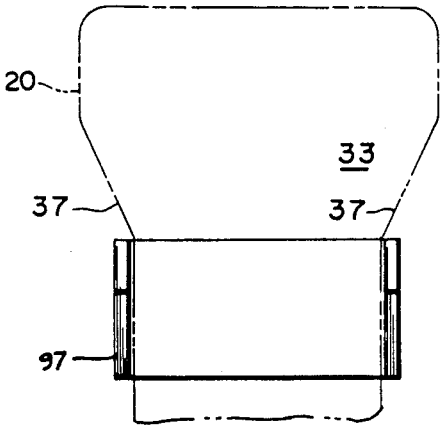

Referring next, and finally, to FIG. 14 A and 14 B, there is depicted a container in a scale substantially that of FIGS. 1, 2 and 3. The flattened ends of said container produce a widened portion that provides an engaging means for a U-shaped bracket for supporting the container on a wall or the like. As seen in FIGS. 14 A and 14 B, a support bracket, generally identified as 97, may be secured to a wall and the like by screws, bolts or the like, which are not shown. A U-shaped metal or plastic member 97 is formed with an open outer portion disposed to slideably engage and retain the tubular body of the container 20. This U-shaped member 97 is preferably made from a flat strip of metal or plastic which may be tapered as shown. This member 97 is attached to a plate 95 by welding, adhesive, bolts or the like. The method of attaching is a matter of selection. The U-shaped member 97 is sized to accommodate the container or containers to be supported.

It is also contemplated that this support bracket may be formed from one piece either of metal, such as aluminum, or of plastic. As the U-shape is open, this portion may be provided with a little spring much as found by and in a pants clip for bicycle riding. Whatever the construction, this support bracket is disposed to removably retain the container at the desired position (usually vertical) and condition. The container can be and often is removed from the support bracket before the contents are removed or when fluid is to be discharged. This support bracket may be and is often used during filling, storage and/or dispensing of contents when the contents are of fluid.

USE AND OPERATION

This container is shown with many closure members and is shown in selected embodiments with an internal bladder or resilient bag that can be pressurized to dispense liquids and/or flowable powders. The supporting of the container in a storage and use position is shown with associated components. This container has many advantages, including selective diameters and lengths. The wall thickness of the container is selected to accommodate the intended use. As noted above, the desired tubular container can be produced in small quantities and in several lengths and tubular sizes. This production requires a minimum tooling cost resulting in low production expenditures.

In FIG. 1, the container 20 is shown with aperture 24 toward the top, but it is realized that the container can be turned end-for-end and that this showing of the aperture is merely a matter for illustration. The container may also be formed with handle portions or apertures 23 in both ends whereat, rather than a shorter end portion 21, the end extent is like 22 shown. The handle portion and the outer edges are smoothed to remove any sharp and potential cutting edges. This does not preclude the making of a container with no handle portions, with both ends formed like end 21 seen in FIGS. 1 and 2. As noted above, the container 20 is made from thermoplastic tubing such as PVC. This does not preclude making the container from sheet material which which is heated and rolled into a tube usually over a mandrel. The longitudinal seam is welded, bonded or cemented to provide an open-ended tube which is then formed as noted above. Also not precluded is injection molding, but the cost of dies for such finished results is usually not practical.

This container is simple to make since adjustment may be made readily in length, diameter and wall thickness. The cutting of such plastic tubing to a desired length is achieved easily. This container may be converted easily from a container for solid materials such as rod-like components, which include cutting bars, welding rods and the like, to a container for liquids and/or powder, including granular. This container provides liquid-tight fittings as shown in above-presented and -described FIGS. A valve (FIG. 10) for draining the fluid contents is also illustrated. It is to be noted that in forming the ends into flattened, substantially centrally-positioned ends, the flattened end portions protrude sufficiently to prevent the container from rolling, particularly when round tubing is used to make the container. These containers can be stacked on their sides and these tapered or sloped portions protect the plugs and fittings from wear and damage from rough handling during shipping and storage. These sloped end portions in which the aperture or vent are formed provide a flat surface for a smooth and positive attachment of a fitting as exemplified above.

Whether the tubular extruded tubing is made of a thin or thicker wall, the skill needed for producing such containers can be achieved readily after a short training period. This is a sharp contrast to that for molding, deep drawing and like skills needed in the production of prior art containers. The container of this invention has a final shape in which the flattened and sealed ends prevent rolling and, as tubular forms, are stacked easily on their sides for storage in a minimum amount of space. The built-in handles (when formed) provide means for carrying the container by hand, hoisting, lashing or suspending.

This container is made of a tough, wear-resistant plastic on which a label may be attached to the outside by cement or the like. The container may be preprinted to indicate the product, instructions for use, danger or warning signs, warranties and the like. The interior contents are not affected by such exterior labels. When this container is to store and dispense fluids such as milk, wherein the integrity of the fluid must be maintained, a removable bladder, bag or liner may be employed as noted in the above FIGS. and description. The bladder can be installed through the aperture 24 in the container 20 and pressurizing can then be used as an assist in the dispensing. This removable liner, bag or bladder can provide the inert sanitary preconditions required for foodstuffs, chemicals or certain granular products. The bladder may or may not be pressurized and gravity may be used to dispense the contents. The bladder may be removed for replacement or disposal, or may be sterilized for refuse and reinsertion.

It is to be noted that a bladder, bag or liner may inserted permanently into the container. When this is desired, the bladder is usually inserted before forming the end seals. The installation process of a bladder is in accordance with the contents to be stored and the severity of use for the bladder. It is to be noted that the container may be pressurized with compressed air or inert gas between the bladder and container shell. This pressurization is achieved easily by using a fitting in the container wall such as shown in FIG. 12 B. The pressurizing of the container without a bladder also permits fluids to be dispensed without syphon tubes and the like. It is also to be noted that the selection of thermoplastic materials allows color selections so that the contents may be identified readily. This is particulary useful where chemicals are involved or mixtures are to be considered.

The container of this invention, although of a comparatively thin wall, allows outside storage with a capability of withstanding most severe environmental conditions. This tubing from which the container is formed can also be stored safely outdoors for long periods of time in the finished or unfinished form.

The above-described container anticipates the squeezing of the end portions together which usually produces a fluid-tight closure, which is usually preferred, but this is not to preclude making of the container less than fluid-tight as permanent or removable bladders, bags or liner members may be used for providing a fluid-tight enclosure. The noting that this container is preferably fluid-tight is that the storage of the components is usually beneficial if moisture is excluded or maintained.

The container of this invention provides a method of forming said container. The container may be made essentially tamperproof with the use of a seal of the nozzle, bag or bladder. This method of making said container includes the steps of:

providing a body portion having a selected length and of a generally tubular shape and cut from a rigid thermoplastic material having a more-or-less regular wall thickness;

heat-softening both end portions of the container and, while softened, using die means for squeezing the walls together to form a contiguous, substantially centrally-positioned, side-by-side condition closed-end portion, with the transition portion from the tubular body portion to the flattened end portion providing two substantially flat and tapered and sloped extents at each end, these tapered portions diverging from the flattened end portion to the original tubular configuration and with these flattened end portions providing extending means that protrude beyond the outer configuration of the tubular body and provide means for preventing unwanted rolling and for desired suspension and the like, and forming and providing an access aperture in and through a substantially flat and tapered portion of the container end, and closing said aperture by a removable member.

Terms such as "left," "right," "up," "down," "bottom," "top," "front," "back," "in," "out" and the like are applicable to the embodiments shown and described in conjunction with the drawings. These terms are merely for the purpose of description and do not necessarily apply to the position in which the container and closure devices may be constructed or used.

While a particular embodiment of the container has been shown and described, it is to be understood that the invention is not limited thereto and protection is sought to the broadest extent the prior art allows.

What is claimed is:

1. A rigid container for rods, fluids, powders and the like, said container formed of a rigid material having a thickness of at least one-sixteenth of an inch (1/16"), said container being characterized by:

(a) a rigid body portion of a selected length in a first direction and a generally tubular shape, said body portion having a inner peripheral surface defining an inner compartment, and an outer peripheral surface;

(b) flattened end portions at opposed ends of said rigid body portion, each end portion including opposed walls attached together and having a transverse dimension, substantially normal to said first direction, between transversely spaced-apart lateral edges, said lateral edges extending transversely beyond the outer peripheral surface of the rigid body portion for preventing unwanted rolling;

(c) a transition portion joining each of said end portions to said rigid body portion, each of said transition portions including two substantially flat, sloping wall portions, said two sloping wall portions diverging from each other in a direction from the flattened end portion to the rigid body portion, a transition portion further including flared, transversely spaced-apart lateral surface extending from the transversely spaced-apart lateral edges of a flattened end portion to the body portion and being engageable for desired suspension and the like;

(d) an access aperture provided by wall means in and through a substantially flat and sloping wall portion of the container; and (e) closure means for closing said access aperture.

2. A container as in claim 1 in which the tubular container is from a plastic with thermoforming properties and the flattening of the ends is by die means while and when said end portions are heat-softened.

3. A container as in claim 1 in which the tubular container is from tubing which may be substantially round, rectangular or the like, and said container body is cut from a longer length of tubing.

4. A container as in claim 3 in which the plastic tubing is PVC.

5. A container as in claim 1 in which in at least one of the flattened end portions there is a sufficient extent so as to have a hand grip aperture or the like formed therein and therethrough, this grip aperture providing means by which manipulation, suspension, indexing, carrying and/or lifting of the container are achieved easily.

6. A container as in claim 1 in which the flattened end portions at the contiguous-facing surface portions are made fluid-tight as by welding, adhesive, cement or the like.

7. A container as in claim 1 in which the access aperture is selectively closed with a tapered plug having side wall portions that are slightly resilient and sized to seal said aperture when forced thereinto, this plug having an outer limiting flange so as to prevent accidental insertion through said aperture.

8. A container as in claim 1 in which the access aperture includes an outwardly-extending, threaded nipple portion, this nipple secured in a permanent manner as by welding, cement or adhesive to the container wall, the outward end of this threaded nipple closed by a removalbe plug, cap, valve, hose or the like.

9. A container as in claim 8 in which the threaded nipple has external threads and the cap member has a like and compatible internally-threaded portion.

10. A container as in claim 8 in which the threaded nipple has internal threads and closure of this nipple is with a threaded plug with external threads.

11. A container as in claim 1 in which the access aperture and the container wall are so thin that female threads formed therein are not sufficient for insertion and retention of a tapered pipe plug or like threaded fittings whereat a doubler patch is added and fixedly secured as by welding, cement or adhesive to that container wall around the access aperture so that a through aperture may be formed and female threads formed therein for removable retention of a tapered pipe plug or like threaded fittings.

12. A container as in claim 1 in which the access opening includes a collar affixed to the container wall by cement, adhesive or welding, and attached to this collar is a flexible spout member with and by a securing means, said securing means providing a fluid-tight seal of the spout to the collar, the other or distal end of the spout selectively closed by a removable cap.

13. A container as in claim 12 in which the securing means for retaining the flexible spout to the collar is a U-shaped ring which is secured by a squeeze tool or the like and the removable cap includes a compatible thread-retaining portion.

14. A container as in claim 1 in which the access opening is closed by a plug assembly which includes inner and outer rigid compression plates, with the inner plate smaller in size than the access aperture so as to easily pass through said aperture, and with the outer rigid compression plate larger than the access aperture so as to prevent passing through said aperture, and between said inner and outer rigid plates is a rubber or rubber-like resilient disc member and there is means for moving the rigid plates together sufficiently to cause the resilient disc to expand sufficiently outward to seal the access aperture.

15. A container as in claim 14 in which the means for moving the inner rigid compression plate toward the outer rigid compression plate includes a carriage bolt and a wing nut carried on the threaded shank of said bolt.

16. A container as in claim 1 in which the access aperture is sized to receive an outwardly-extending nipple which is secured to the container side wall to provide a fluid-tight seal as by welding, cement or adhesive, and on the outer end of this nipple is mounted a turn valve which is selectively manipulated to provide the selective open and closed condition.

17. A container as in claim 16 in which the valve is rotated to provide said open and closed condition and the outer portion of this valve is threaded to provide connection means for a conduit for drainage, dispensing, filling or venting of the container.

18. A container as in claim 1 in which the container is made pressure- and fluid-tight, and there is also provided in a sloped side portion of the container a selectively-opened and -closed vent.

19. A container as in claim 18 in which the vent includes an internally-threaded body in which a threaded plug is screwed in and out to open and close said vent.

20. A container as in claim 1 in which the ends of the container are made pressure- and fluid-tight and the access aperture is closed by an assembly which includes an inner rigid compression plate member having a hollow stem portion disposed toward the outside, this inner plate member of a smaller size than the aperture so as to be inserted therethrough, a rubber or rubber-like resilient disc member between inner and outer compression plates and sized so as to be insertable in the access aperture, an outer rigid compression plate member larger than the access aperture, the hollow stem having threads on which a threaded nut is mounted and advanced so as to move the outer rigid compression plate toward the inner plate and cause the resilient disc member to be bulged outwardly to an expanded condition so as to seal the aperture, and a check valve secured to the outer extent of the stem to selectively close the hollow stem to flow to and from the container.

21. A container as in claim 20 in which the threaded nut mounted on the hollow stem is configured so as to be rotated only with a special tool.

22. A container as in claim 20 in which the check valve is removably mounted on an outer threaded portion of the stem.

23. A container as in claim 20 in which the container is also provided with a bag, bladder and the like which is inserted or removed through the access aperture and retained by the expanded resilient disc, and there is provided a pressure valve means to selectively insert pressurized air through this valve into the interior of the container.

24. A container as in claim 23 in which pressurized air, or similar fluids, is fed to the interior of the container through a tubeless tire-type valve stem, which stem is inserted and mounted in its own hole formed in a sloped portion of the container.

25. A container as in claim 1 in which there is additionally provided a support stand secured to said support base and spaced so as to provide a slot therebetween and adapted to removably receive and retain a flattened end portion of the container to provide a more-or-less upright retention and support of the container.

26. A container as in claim 1 in which there is additionally provided a support clip having two extending arms which provide an open-U-shape space adapted to removably receive and retain an outwardly-flared portion of an end of the container, with the extending arms engaging the widened portion of the container end to provide the desired engagement and support of the container.

27. A rigid container for rods, fluids, powders and the like, said container formed of a rigid material having a thickness of at least one-sixteenth of an inch (1/16"), said container being characterized by:

(a) a rigid body portion of a selected length and of a generally tubular shape, said body portion having an inner peripheral surface defining an inner compartment, and an outer peripheral surface;

(b) flattened end portions at each end of said body portion, each of said end portions including opposed walls attached together;

(c) a transition portion interconnecting each flattened end portion with the rigid body portion, each transition portion including two substantially flat and sloped wall portions which diverge from each other in a direction from the flattened end portion to the rigid body portion; and (d) wall means providing two access apertures, each of said access apertures being in a sloped wall portion of a transition portion and communicating with the inner compartment of the rigid body portion, one of said access apertures communicating with the inner compartment for permitting material within the compartment to be dispensed, and the other of said apertures including vacuum vent means for preventing a vacuum from being established in the inner compartment.

28. The container of claim 23 including flexible liner means disposed within the inner compartment of the rigid body portion, said flexible liner means having an inner surface defining an opening through which material to be packaged can pass, a section of said flexible liner means adjacent said opening extending through said one of said access apertures, and compression seal means disposed within the opening of the flexible liner means for pressing the flexible liner means into sealing engagement with the wall means defining said one of said access apertures.

29. The container of claim 28 wherein said flexible liner means extends outwardly beyond the compression seal means and is sealed closed in a location overlying the compression seal means to provide a tamper-evident closure for the container.

30. The container of claim 28 wherein said compression seal means includes a passageway therein for permitting the dispensing of said material from said flexible liner means.

31. The container of claim 30 wherein said flexible liner means extends outwardly beyond the compression seal means and is sealed closed in a location overlying the compression seal means to provide a tamper-evident closure for the container.

32. The container of claim 28 wherein said flexible liner means is a flexible bag or flexible bladder for retaining material to be packaged therein.

33. The container of claim 32 wherein the other of said access apertures communicates with the inner compartment of the rigid body portion in a region of said inner compartment disposed between the flexible bag or bladder and the inner peripheral surface of the rigid body portion.

34. The container of claim 32 wherein said flexible bag or bladder extends outwardly beyond the compression seal means and is sealed closed in a location overlying the compression seal means to provide a tamper-evident closure for the container.

35. A rigid container for rods, fluids, powders and the like, said container formed of a rigid material having a thickness of at least one-sixteenth of an inch (1/16″), said container being characterized by:

(a) a rigid body portion of a selected length and of a generally tubular shape, said body portion having an inner peripheral surface defining an inner compartment, and an outer peripheral surface;

(b) flattened end portions at each end of said body portion, each of said end portions including opposed walls attached together;

(c) a transition portion interconnecting each flattened end portion with the rigid body portion, each transition portion including two substantially flat and sloped wall portions which diverge from each other in a direction from the flattened end portion to the rigid body portion; and (d) wall means providing two access apertures, each of said access apertures being in a sloped wall portion of a transition portion and communicating with the inner compartment of the rigid body portion, one of said access apertures communicating with the inner compartment for permitting material within the compartment to be dispensed, and the other of said apertures including a valve means for permitting the inner compartment to be pressurized.

36. The container of claim 35 including flexible liner means disposed within the inner compartment of the rigid body portion, said flexible liner means having an inner surface defining an opening through which material to be packaged can pass, a section of said flexible liner means adjacent said opening extending through said one of said access apertures, and compression seal means disposed within the opening of the flexible liner means for pressing the flexible liner means into sealing engagement with the wall means defining said one of said access apertures.

37. The container of claim 36 wherein said flexible liner means extends outwardly beyond the compression seal means and is sealed closed in a location overlying the compression seal means to provide a tamper-evident closure for the container.

38. The container of claim 36 wherein said compression seal means includes a passageway therein for permitting the dispensing of said material from said flexible liner means.

39. The container of claim 38 wherein said flexible liner means extends outwardly beyond the compression seal means and is sealed closed in a location overlying the compression seal means to provide a tamper-evident closure for the container.

40. The container of claim 36 wherein said flexible liner means is a flexible bag or flexible bladder for retaining material to be packaged therein.

41. The container of claim 40 wherein the other of said access apertures communicates with the inner compartment of the rigid body portion in a region of said inner compartment disposed between the flexible bag or bladder and the inner peripheral surface of the rigid body portion.

42. The container of claim 40 wherein said flexible bag or bladder extends outwardly beyond the compression seal means and is sealed closed in a location overlying the compression seal means to provide a tamper-evident closure for the container.

* * * * *